US005699567A

United States Patent [19]

Sanders et al.

[11] Patent Number: 5,699,567

[45] Date of Patent: Dec. 23, 1997

[54] SUPPORT APPARATUS

[75] Inventors: Mark Andrew Sanders, Windsor; Alexander Joseph Kalogroulis, Coulsdon, both of United Kingdom

[73] Assignee: Keymed (Medical & Industrial Equipment) Ltd., Essex, United Kingdom

[21] Appl. No.: 669,455

[22] PCT Filed: Dec. 1, 1995

[86] PCT No.: PCT/GB95/02814

§ 371 Date: Jul. 8, 1996

§ 102(e) Date: Jul. 8, 1996

[87] PCT Pub. No.: WO96/16628

PCT Pub. Date: Jun. 6, 1996

[30] Foreign Application Priority Data

Dec. 1, 1994 [GB] United Kingdom ..... 9424299

[51] Int. Cl.[6] ..... A61G 7/00; A61G 5/00

[52] U.S. Cl. ..... 5/614; 5/617; 5/501.6

[58] Field of Search ..... 5/614, 617; 74/489, 74/501.6

[56] References Cited

U.S. PATENT DOCUMENTS

| | | | |
|---|---|---|---|
| 3,886,250 | 5/1975 | Bradford | 5/617 |
| 4,222,131 | 9/1980 | Holdt et al. | 5/617 |
| 4,346,487 | 8/1982 | Holdt et al. | 5/617 |
| 4,751,755 | 6/1988 | Carey, Jr. et al. | 5/617 |
| 5,575,026 | 11/1996 | Way et al. | 5/617 |

FOREIGN PATENT DOCUMENTS

| | | |
|---|---|---|
| 2048661 | 12/1980 | United Kingdom . |
| 2256132 | 12/1992 | United Kingdom . |
| 94/09738 | 5/1994 | WIPO . |

OTHER PUBLICATIONS

United Kingdom Patent Office Report Mar. 15, 1995.

*Primary Examiner*—Michael F. Trettel

*Attorney, Agent, or Firm*—Beveridge, DeGrandi, Weilacher & Young, L.L.P.

[57] ABSTRACT

With reference to FIG. 1, there is described a support apparatus (1) for supporting a patient at an adjustable position. A handle (5) is provided by which an operator may apply an adjusting force to the support apparatus (2). A locking mechanism (12) retains the support apparatus at a required position. A release mechanism is also provided to release the locking mechanism (12) to allow adjustment. This release mechanism comprises a cable (19), a portion of which extends in proximity to part of the handle (5) so that in use the operator may clasp the cable (19) to the handle (5) thereby to pull the cable (19) and activate the release mechanism.

12 Claims, 4 Drawing Sheets

12
13
14
15
16
17
18
19
20
21
22
23
24
25
26
27
28
29
30
31
32
33
34
35
36
37
38
5
6
7
8
9
10
11
2

12
13
14
15
16
17
18
19
20
21
22
23
24
29
30
31
32
33
34
5
6
7
8
9
10
11

SUPPORT APPARATUS

This invention relates to support apparatus for supporting a patient at an adjustable position by means of a support member connected adjustably to a supporting structure and in particular but not exclusively to such apparatus comprising a release mechanism for a back rest of a chair bed.

It is known from W094/21209 to provide a support apparatus in the form of a chair bed in which a back rest constitutes a support member which is pivotally adjustable relative to a supporting structure including a seat. An adjustable leg rest and foot rest are additionally provided so that the apparatus can be used either as a bed, chair or wheelchair for a patient.

A locking mechanism is provided to secure the support member in any desired position, a manually operable release mechanism being provided to release the locking mechanism to allow adjustment.

It is also known from W094/09738 to provide a patient transport trolley in which a back rest release mechanism is actuated by movement of an operating element in the form of a lever coupled to the release mechanism by a cable control mechanism.

According to the present invention there is disclosed support apparatus for supporting a patient at an adjustable position comprising a support member connected adjustably to a supporting structure, a handle connected to the support member such that in use an operator gripping the handle may apply an adjusting force to the support member, a locking mechanism for retaining the support member at a required position and a release mechanism operable to release the locking mechanism to allow adjustment, wherein the release mechanism comprises a cable connected to the locking mechanism such that the locking mechanism is releasable in response to the cable being pulled and wherein the cable includes an actuating portion normally extending in proximity to a co-operating portion of the handle such that in use the actuating portion may be clasped to the handle by an operator gripping the co-operation portion of the handle to thereby pull the cable and actuate the release mechanism.

An advantage of such apparatus is that the operator may, in a single movement with one hand, adjust the position of the support member by grasping the handle and cable together. The operator may alternatively choose to grasp the handle at the same location without clasping the cable to the handle so that the handle remains available for use in maneuvering the support apparatus as a whole without releasing the locking mechanism. A further advantage is that the actuating portion may extend alongside a relatively long co-operating portion of the handle so that the location at which the operator grips the handle need not be narrowly defined as in the case of prior art arrangements having localised levers or catches.

Preferably the actuating portion of the cable is enclosed within a flexible extensible sheath.

The operator's fingers are thereby protected from contact with the cable and from abrasion resulting from longitudinal movement of the cable when pulled.

Preferably the handle is tubular, the cable extending through the handle, and the handle is provided with side openings allowing the actuating portion of the cable to extend externally of the co-operating handle portion.

Advantageously the cable comprises at least one further actuating portion extending externally of respective further co-operating handle portions via respective side openings.

The release mechanism may then be actuated using any one of the actuating portions. In particular, by arranging actuating portions on opposite sides of the supporting structure, the operator may select whichever actuating portion is most convenient in a given situation.

Conveniently the release mechanism comprises an operating member coupled to the cable by a resilient coupling and further comprising stop means operable to limit actuating movement of the operating member whereby pulling of the cable to an extent beyond that which is required for the stop means to be engaged by the operating member is accommodated by deformation of the resilient coupling.

In a preferred embodiment the resilient coupling is a helical spring held in compression and the operating member is a pivoting arm.

Conveniently the spring is also operable to maintain the cable in tension.

Preferred embodiments of the present invention will now be described by way of example only and with reference to accompanying drawings of which FIG. 1 is a schematic plan view of a horizontal back rest showing the handle, cable and locking mechanism;

Figure 4:
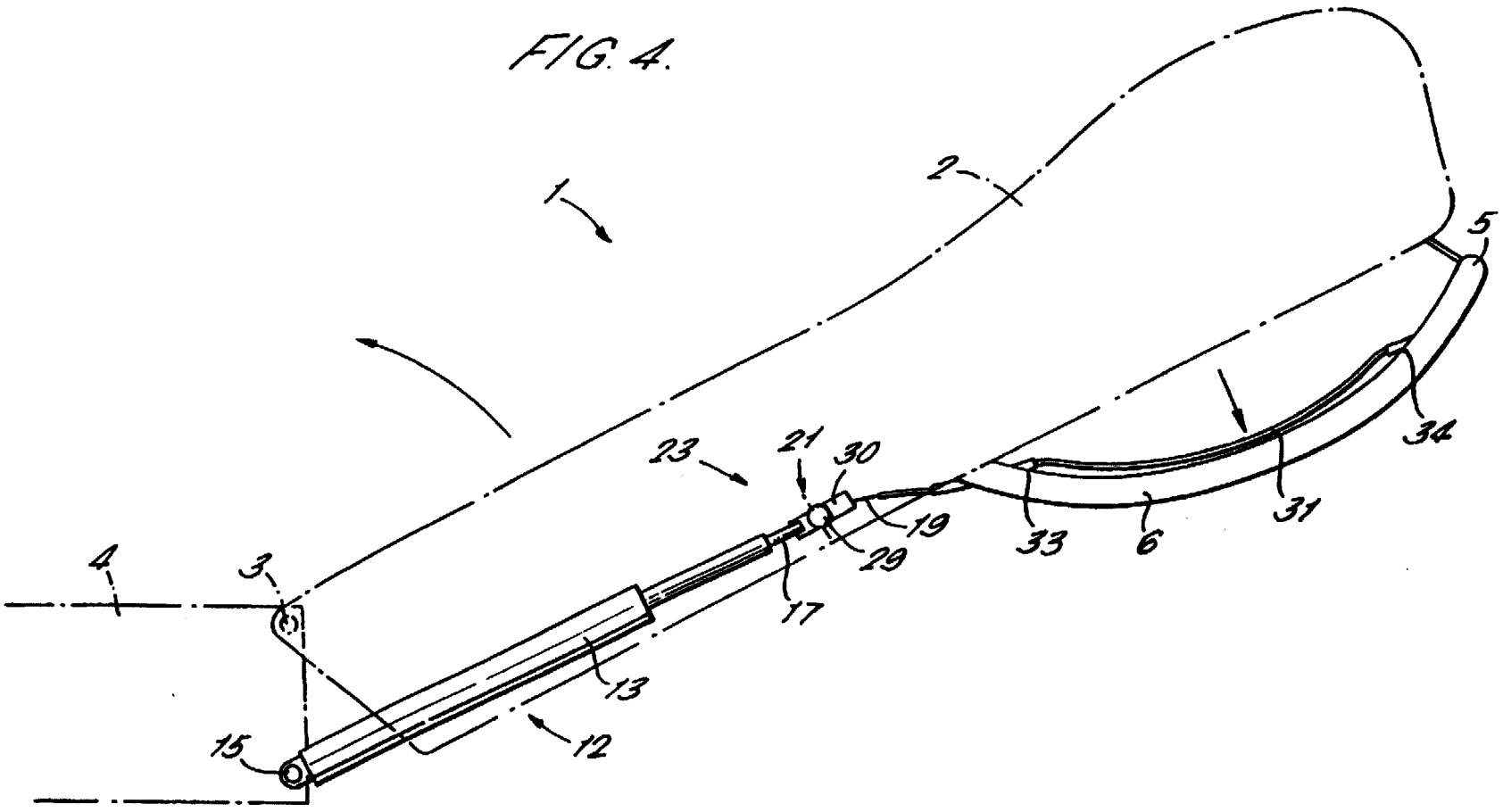
FIG. 4 is a side elevation of the back rest after pivotal adjustment and with the cable corresponding to the actuated position of FIG. 3.

As shown in FIG. 4, a support apparatus 1 has a support member 2 constituting a back rest which is pivotally connected about a pivot 3 to a seat 4 constituting a supporting structure. As seen more clearly in FIG. 1, a generally U-shaped handle 5 of tubular construction is mounted on the support member 2 so as to extend around the sides and free end of the support member.

The handle 5 includes left and right-hand arcuate portions 6 and 7 which are bowed so as to stand off from the sides 8 and 9 of the support member 2 thereby defining respective apertures 10 and 11. The arcuate portions 6 and 7 may thereby be grasped by an operator such that the operator's fingers extend through the apertures 10 and 11.

The support apparatus 1 is provided with a locking mechanism 12 consisting of left and right-hand locking gas struts 13 and 14 which extend between mounting points 15 and 16 on the supporting structure 4 and support member 2 respectively, the gas struts being variable in length and lockable at any desired extension so that the angular position of the support member 2 relative to the seat 4 is adjustable.

The gas struts 13 and 14 are releasable by axial depression of respective actuator rods 17 and 18 which are resiliently biased into an extended position in which the gas struts are locked into position.

A flexible but non-extensible cable 19 extends through the tubular handle 5 and has first and second free ends 20 and 21 which are coupled to the actuator rods 17 and 18 by respective first and second couplings 22 and 23 arranged such that the actuator rods are axially displaced to release the locking mechanism 12 when the cable is pulled to thereby constitute a release mechanism.

Figure 3:
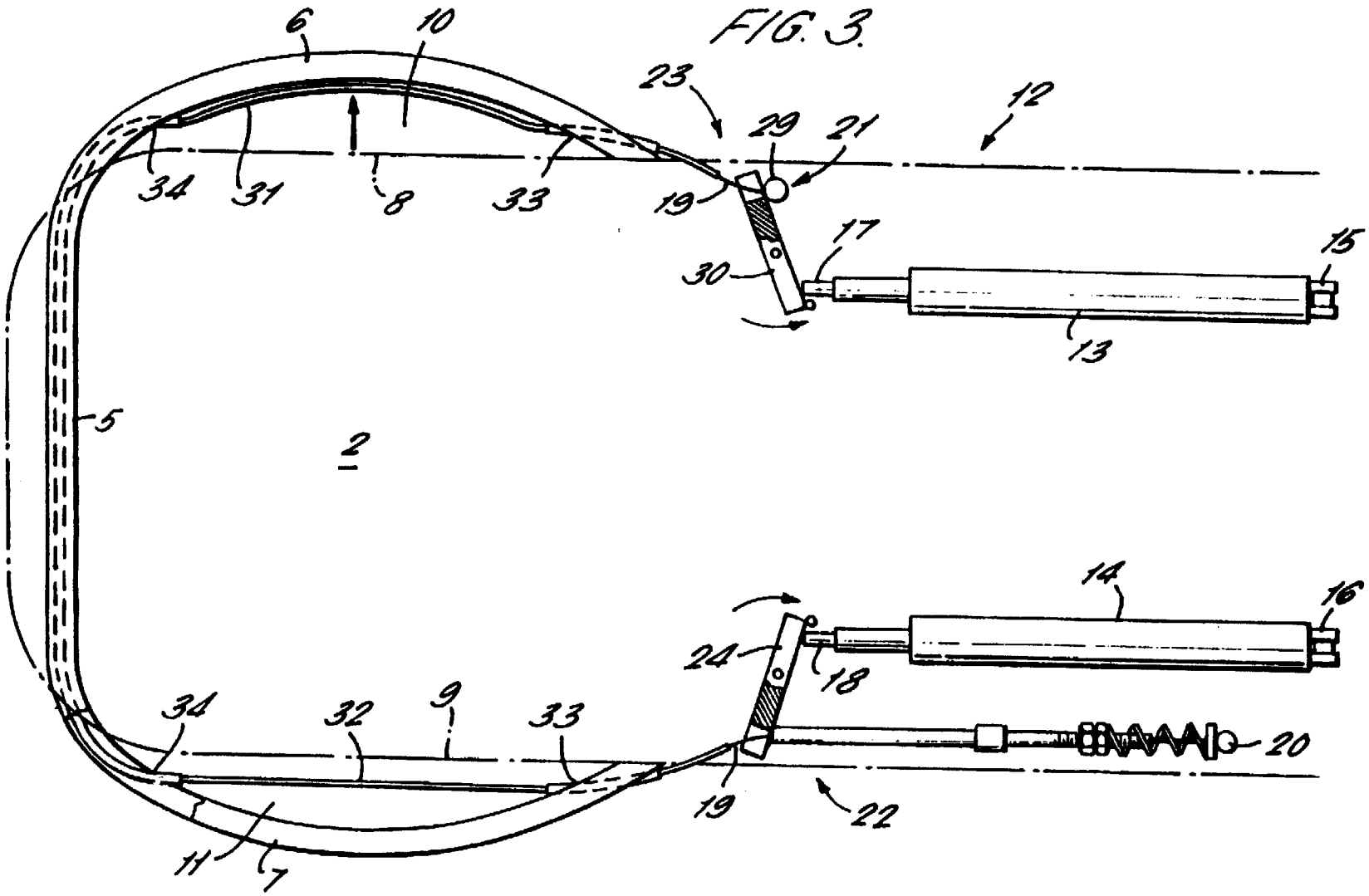
FIG. 3 is a plan view corresponding to FIG. 1 and showing the cable in an actuated position.

The first coupling 22 as seen in FIGS. 3 and 4 consists of a centrally pivoted arm 24 engaged at one end by a rigid sheath 25 through which the cable 19 extends, the pivoted arm 24 contacting at its other end the actuator rod 17. The free end 20 of the cable projects from the rigid sheath 25 such as to accommodate a helical spring 26 held in compression between a terminal 27 formed at the end of the cable and an adjustable stop 28 which is screw-threaded onto the rigid sheath 25.

The second free end 21 of the cable 19 has a terminal 29 directly coupled to one end of a second pivoted arm 30 which is centrally pivoted and which engages at its other end the actuator rod 17.

First and second actuating portions 31 and 32 of the cable 19 extend externally of the tubular handle 5 so as to traverse the apertures 10 and 11 in proximity with the arcuate portions 6 and 7 of the handle. The actuating portions 31 and 32 normally extend linearly between side openings 33 and 34 formed in the handle, the holes being located such that the linear extent of the actuating portions is spaced from the sides 8 and 9 of the support member 2 by a distance which is sufficient to allow the operator's fingers to be inserted between the cable and the sides.

In use, an operator wishing to adjust the position of the support member 2 grasps an arcuate portion 6 of the handle 5 such that the operator's fingers extend through aperture 10 and clasp the actuating portion 31 of the cable 19 towards the handle. In doing so, the actuating portion 31 of the handle 5 is deformed from its linear configuration thereby effecting a pulling action which is transmitted to the free ends 20 and 21.

The actuating portions 31 and 32 of the cable 19 are enclosed in respective flexible sheaths 35, 36 formed of a plastics material which is longitudinally extensible to a degree which is sufficient not to restrict elongation of the actuating portion during this clasping motion.

The flexible sheaths 35 and 36 thereby avoid direct contact between the operator's hand and the metallic material of the cable.

Pulling the cable 19 in this way effects release of the locking mechanism 12 by applying pivotal moments to the pivoted arms 24 and 30 so as to depress the actuator rods 17 and 18. The limit of pivotal travel of the arms 24 and 30 is defined by stops 37 and 38 respectively. The support member may then be adjusted using the handle 5. When the cable is released by the operator, the actuator rods 17 and 18 return to their normal position by action of spring bias and thereby return the pivoted arms 24 and 30 to their rest positions. The locking mechanism 12 is then locked again.

The spring 26 maintains the cable 19 in tension and allows over-travel of the terminal 27 in response to pulling of the cable 19 to an extent which is greater than that required to move the actuator rods 17 and 18 through their full stroke.

In practice, the actuator rods 17, 18 require only a short travel before they fully release their respective gas struts 13, 14. The positions of the stops 37, 38 are therefore set such that the arms 24, 30 are arrested by the stops immediately after the respective gas strut is released. Typically, pulling the actuating portion 31 or 32 will result in only one of the arms 24, 30 initially moving, until the moving arm is arrested by the stop 37, 38. The pulling action is then transferred to the other arm until it too encounters its respective stop. Further pulling action is taken up by compression of the spring 26.

A particular advantage of the above described apparatus is that the locking mechanism 12 may be released by an operator using only one hand. The operatore may select whichever of the actuating portions 31, 35 comes most conveniently to hand, the release mechanism being operable with equal facility in each case.

Figure 1:
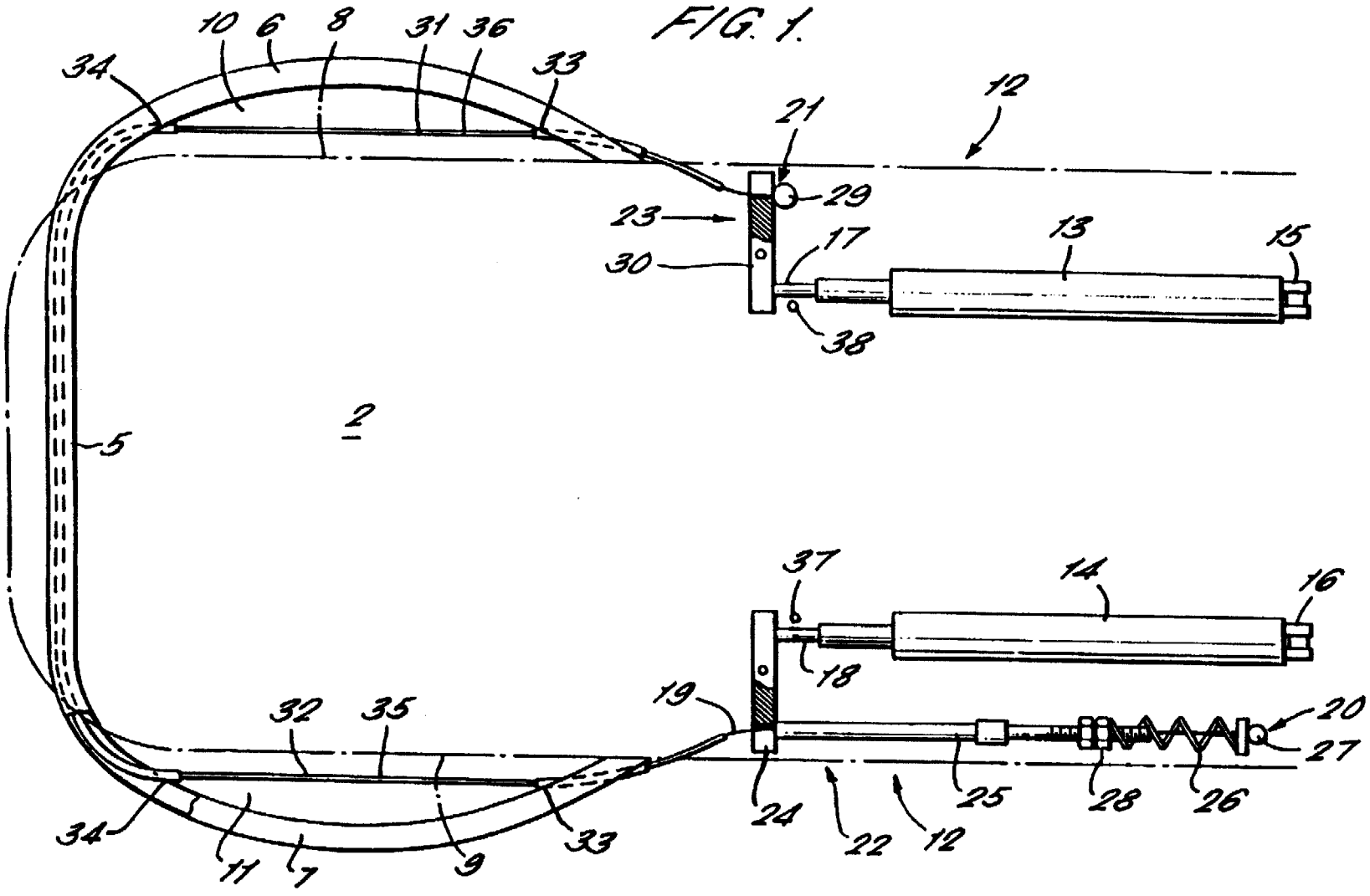
Figure 2:
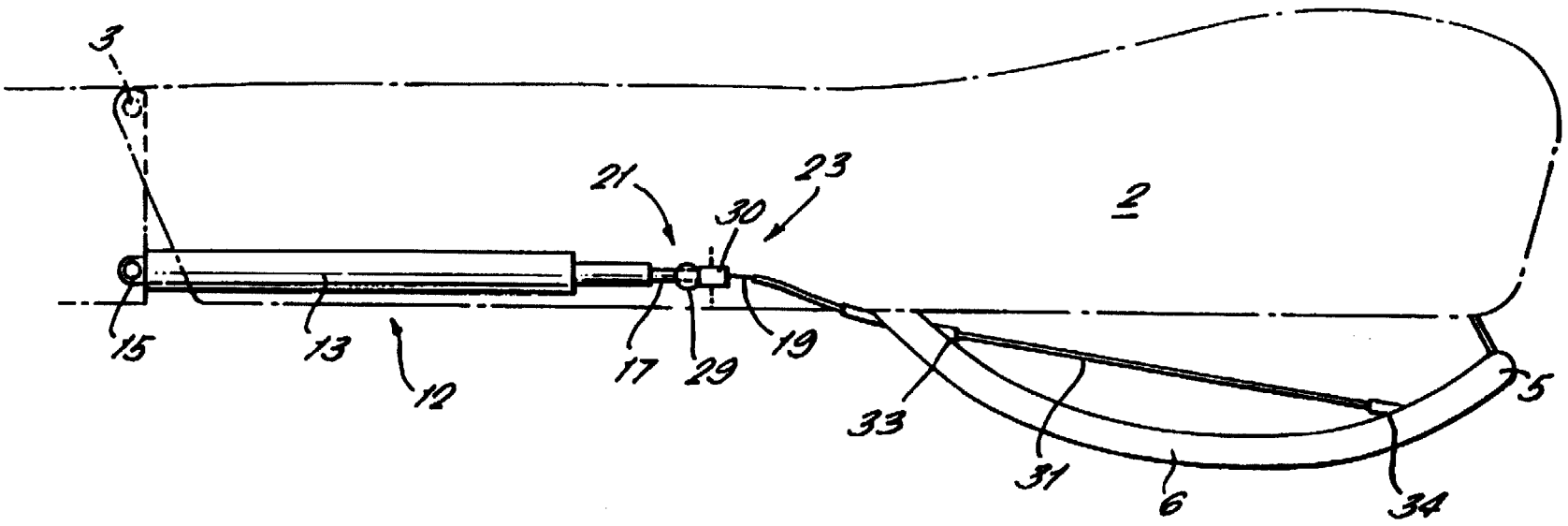
FIG. 2 is a side elevation of the back rest of FIG. 2.

Alternative embodiments are envisaged in which only a single gas strut is provided, the arrangement of FIG. 1 thereby being modified to omit the second as strut 14 and to fixedly secure the terminal 29 of the second free end 21 at a fixed location. Alternatively the gas struts may be replaced by one or more equivalent mechanisms.

A further alternative which may be combined with any of the above varients is to provide the handle with an additional arcuate portion and co-operating actuating portion of cable extending transversely of the support member 2. Alternatively such a transversely disposed cable release mechanism may replace the above described longitudinally extending cable mechanisms constituted by arcuate portions 6 and 7 and actuating cable portions 31 and 32.

The above described arcuate portions of handle may alternatively be replaced by linearly extending portions of the handle provided that they are arranged to stand off from the sides 8 and 9 of the support member 2.

We claim:

1. Support apparatus for supporting a patient at an adjustable position comprising a support member connected adjustably to a supporting structure, a handle connected to the support member such that in use an operator gripping the handle may apply an adjusting force to the support member, a locking mechanism for retaining the support member at a required position and a release mechanism operable to release the locking mechanism to allow adjustment, wherein the release mechanism comprises a cable connected to the locking mechanism such that the locking mechanism is releasable in response to the cable being pulled and wherein a portion of the cable forms an actuating portion normally extending in proximity to a cooperating portion of the handle such that in use the actuating portion may be clasped to the handle by an operator gripping the actuating portion and the co-operation portion of the handle to thereby pull the cable and actuate the release mechanism.

2. Support apparatus as claimed in claim 1 wherein the actuating portion is enclosed within a flexible extensible sheath.

3. Support apparatus as claimed in claim 1 wherein the handle is tubular, the cable extending through the handle, and the handle being provided with side openings allowing the actuating portion of cable to extend externally of the co-operating handle portion.

4. Support apparatus as claimed in claim 3 wherein the cable comprises at least one further actuating portion extending externally of respective further co-operating handle portions via respective side openings.

5. Support apparatus as claimed in claim 1 wherein the release mechanism comprises an operating member coupled to the cable by a resilient coupling and further comprising stop means operable to limit actuating movement of the operating member whereby pulling of the cable to an extent beyond that which is required for the stop means to be engaged by the operating member is accommodated by deformation of the resilient coupling.

6. Support apparatus as claimed in claim 5 wherein the resilient coupling comprises a spring operable to maintain the cable in tension.

7. Support apparatus as claimed in claim 1 wherein the locking mechanism comprises at least one gas strut.

8. Support apparatus as claimed in claim 1 wherein the support member comprises a back rest pivotally connected to a seat portion of the support apparatus.

9. Support apparatus as claimed in claim 1 wherein the support apparatus is constituted by a chair bed.

10. Support apparatus for supporting a patient at an adjustable position comprising a support member connected adjustably to a supporting structure, a handle connected to the support member such that in use an operator gripping the handle may apply an adjusting force to the support member, a locking mechanism for retaining the support member at a required position and a release mechanism operable to release the locking mechanism to allow adjustment, wherein the release mechanism comprises a cable connected to the locking mechanism such that the locking mechanism is releasable in response to the cable being pulled, wherein the cable includes an actuating portion normally extending in proximity to a co-operating portion of the handle such that in use the actuating portion may be clasped to the handle by an operator gripping the co-operation portion of the handle to thereby pull the cable and actuate the release mechanism and wherein the handle is tubular, the cable extending through the handle, and the handle being provided with side openings allowing the actuating portion of the cable to extend externally of the co-operating handle portion.

11. Support apparatus as claimed in claim 10 wherein the cable comprises at least one further actuating portion extending externally of respective further co-operating portions via respective side openings.

12. Support apparatus for supporting a patient at an adjustable position comprising a support member connected adjustably to a supporting structure, a handle connected to the support member such that in use an operator gripping the handle may apply an adjusting force to the support member, a locking mechanism for retaining the support member at a position relative to the support structure, and a release mechanism operable to release the locking mechanism to allow adjustment of the support member, wherein the release mechanism comprises a cable connected to the locking mechanism and the locking mechanism is releasable in response to an actuating portion of the cable being pulled, and wherein the actuating portion of the cable has a normal position and an releasing position, in the normal position the actuating portion is extending in proximity to a cooperating portion of the handle and in the releasing position the actuating portion is pulled to the handle by an operator gripping the actuating portion of the cable and the cooperation portion of the handle, thereby operating the release mechanism.

* * * * *